US010433383B1

(12) United States Patent
Peng

(10) Patent No.: US 10,433,383 B1
(45) Date of Patent: Oct. 1, 2019

(54) LIGHT EMITTING DIODE DRIVING APPARATUS WITH SWITCH CONTROL CIRCUIT

(71) Applicant: Semisilicon Technology Corp., New Taipei (TW)

(72) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 0 days.

(21) Appl. No.: 16/042,104

(22) Filed: Jul. 23, 2018

(51) Int. Cl.
*H05B 33/08* (2006.01)

(52) U.S. Cl.
CPC ..... *H05B 33/0824* (2013.01); *H05B 33/0851* (2013.01)

(58) Field of Classification Search
CPC ..... H05B 33/0815; H05B 33/0842; H05B 33/0845; H05B 33/0887
USPC ..... 315/186, 193, 297, 307
See application file for complete search history.

(56) References Cited

U.S. PATENT DOCUMENTS

2010/0127672 A1* 5/2010 Chen ..... G09G 3/3406 323/222
2011/0140619 A1* 6/2011 Lin ..... H02M 3/158 315/193
2013/0002159 A1* 1/2013 Chen ..... H05B 33/0815 315/200 R
2013/0063047 A1* 3/2013 Veskovic ..... H05B 33/0815 315/307
2014/0354166 A1* 12/2014 Yu ..... H05B 33/0818 315/201
2017/0201187 A1* 7/2017 Himeda ..... H02M 7/06
2018/0177009 A1* 6/2018 Zhang ..... H05B 33/0815

FOREIGN PATENT DOCUMENTS

CN 102511200 B 2/2016
TW 201328418 A 7/2013
TW 201509230 A 3/2015
TW I543664 B 7/2016
TW M534491 U 12/2016

* cited by examiner

*Primary Examiner* — Tung X Le
(74) *Attorney, Agent, or Firm* — Muncy, Geissler, Olds & Lowe, P.C.

(57) ABSTRACT

A light emitting diode driving apparatus includes a control unit, a switch control circuit, a signal switch unit and a control power unit. The control power unit, the signal switch unit and a plurality of light emitting diode units are connected in series. The control power unit supplies power to the control unit. The control unit controls the switch control circuit to turn on the signal switch unit, so that a direct current power is through the signal switch unit to form a high-level part of a lighting signal for driving the light emitting diode units. The control unit controls the switch control circuit to turn off the signal switch unit, so that a low-level part of the lighting signal is formed.

12 Claims, 9 Drawing Sheets

LIGHT EMITTING DIODE DRIVING APPARATUS WITH SWITCH CONTROL CIRCUIT

BACKGROUND OF THE INVENTION

Field of the Invention

The present invention relates to a light emitting diode driving apparatus, and especially relates to a light emitting diode driving apparatus with a switch control circuit.

Description of the Related Art

Currently, light emitting diodes are used widely. A light emitting diode driving apparatus drives the light emitting diodes, so that the light emitting diode driving apparatus is very important.

FIG. 7 shows a block circuit diagram of the related art light emitting diode driving apparatus. A related art light emitting diode driving apparatus 50 is applied to a plurality of light emitting diode units 20, an alternating current power supply apparatus 30 and a direct current power supply apparatus 40. The related art light emitting diode driving apparatus 50 comprises a control power unit 120, a control unit 102, a signal switch unit 106, a signal-side resistor 118 and a signal voltage generation unit 108.

The control power unit 120 supplies power to the control unit 102. As shown in FIG. 7, when the control unit 102 works, there are two currents flowing through the signal-side resistor 118: a first current 122 from the control power unit 120 and a second current 124 from the control unit 102.

If the control unit 102 comprises a wireless function, the second current 124 from the control unit 102 is larger, so that the signal-side resistor 118 is overheated, and the related art light emitting diode driving apparatus 50 has an overheating problem.

SUMMARY OF THE INVENTION

In order to solve the above-mentioned problems, an object of the present invention is to provide a light emitting diode driving apparatus with a switch control circuit.

In order to achieve the object of the present invention mentioned above, the light emitting diode driving apparatus of the present invention is applied to a plurality of light emitting diode units. The light emitting diode driving apparatus comprises a control unit, a switch control circuit, a signal switch unit and a control power unit. The switch control circuit is electrically connected to the control unit. The signal switch unit is electrically connected to the control unit, the switch control circuit and the light emitting diode units. The control power unit is configured to receive a direct current power to provide the control unit with a working power. The control power unit is electrically connected to the control unit, the switch control circuit and the signal switch unit. The control power unit, the signal switch unit and the light emitting diode units are connected in series. Moreover, the control unit is configured to control the switch control circuit to switch a turned-on status and a turned-off status of the signal switch unit to generate a lighting signal to drive the light emitting diode units. When the signal switch unit is turned on, the direct current power is through the signal switch unit to form a high-level part of the lighting signal. When the signal switch unit is turned off, the direct current power is not through the signal switch unit, so that a low-level part of the lighting signal is formed.

The advantage of the present invention is to avoid an overheating problem of the light emitting diode driving apparatus.

Please refer to the detailed descriptions and figures of the present invention mentioned below for further understanding the technology, method and effect of the present invention.

DETAILED DESCRIPTION OF THE INVENTION

Figure 1:
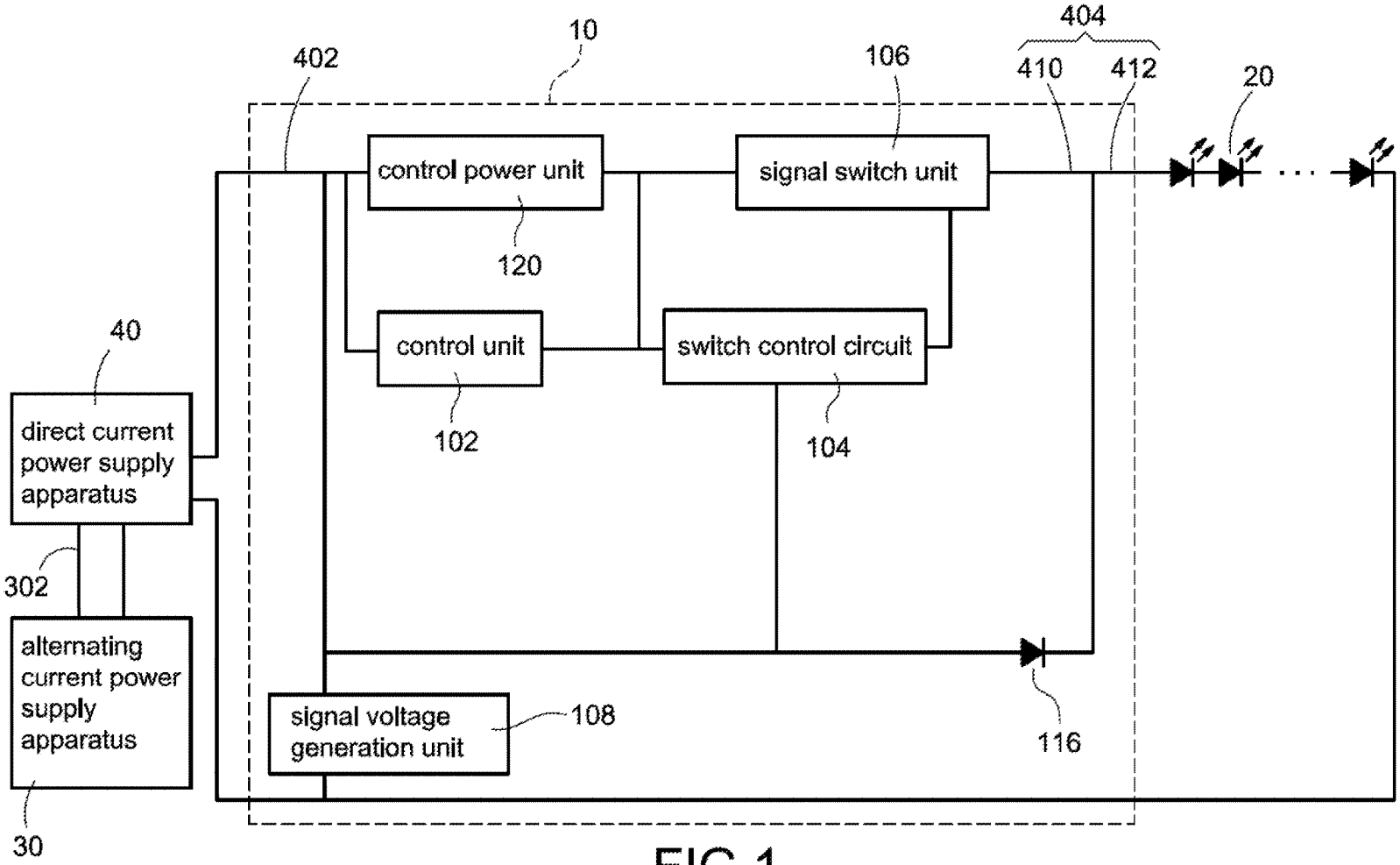
FIG. 1 shows a block circuit diagram of the first embodiment of the light emitting diode driving apparatus of the present invention.

FIG. 1 shows a block circuit diagram of the first embodiment of the light emitting diode driving apparatus of the present invention. A light emitting diode driving apparatus 10 of the present invention is applied to a plurality of light emitting diode units 20, an alternating current power supply apparatus 30 and a direct current power supply apparatus 40. The light emitting diode units 20 are connected to each other in series. The light emitting diode units 20 are, for example but not limited to, a plurality of two-pin light emitting diodes.

The light emitting diode driving apparatus 10 comprises a control unit 102, a switch control circuit 104, a signal switch unit 106, a diode 116, a signal voltage generation unit 108 and a control power unit 120. The switch control circuit 104 is electrically connected to the control unit 102. The signal switch unit 106 is electrically connected to the control unit 102, the switch control circuit 104 and the light emitting diode units 20. The signal voltage generation unit 108 is electrically connected to the control unit 102 and the switch control circuit 104. The diode 116 is electrically connected to the control unit 102, the switch control circuit 104, the light emitting diode units 20, the signal voltage generation unit 108 and the signal switch unit 106. The control power unit 120 is electrically connected to the control unit 102, the switch control circuit 104 and the signal switch unit 106. The control power unit 120, the signal switch unit 106 and the light emitting diode units 20 are connected in series.

The alternating current power supply apparatus 30 sends an alternating current power 302 to the direct current power supply apparatus 40. The direct current power supply apparatus 40 converts the alternating current power 302 to obtain a direct current power 402. The direct current power supply apparatus 40 sends the direct current power 402 to the light emitting diode driving apparatus 10. The control power unit 120 receives the direct current power 402 to provide the control unit 102 with a working power. When a high-level part 410 of a lighting signal 404 is formed, the control unit 102 controls the switch control circuit 104 to turn on the signal switch unit 106, so that the direct current power 402 is through the signal switch unit 106 to form the high-level part 410 of the lighting signal 404 for driving the light emitting diode units 20. When a low-level part 412 of the lighting signal 404 is formed, the control unit 102 controls the switch control circuit 104 to turn off the signal switch unit 106, so that the signal voltage generation unit 108 utilizes the direct current power 402 to form the low-level part 412 of the lighting signal 404. The light emitting diode driving apparatus 10 sends the lighting signal 404 comprising the high-level part 410 and the low-level part 412 to the light emitting diode units 20 to drive the light emitting diode units 20 to light diversely. Moreover, the high-level part 410, the low-level part 412 and the lighting signal 404 will be described in detail later. The control power unit 120 supplies power to the control unit 102.

In other words, the control unit 102 controls the switch control circuit 104 to switch a turned-on status and a turned-off status of the signal switch unit 106 to generate the lighting signal 404 to drive the light emitting diode units 20. When the signal switch unit 106 is turned on, the direct current power 402 is through the signal switch unit 106 to form the high-level part 410 of the lighting signal 404. When the signal switch unit 106 is turned off, the direct current power 402 is not through the signal switch unit 106, so that the low-level part 412 of the lighting signal 404 is formed.

Figure 2:
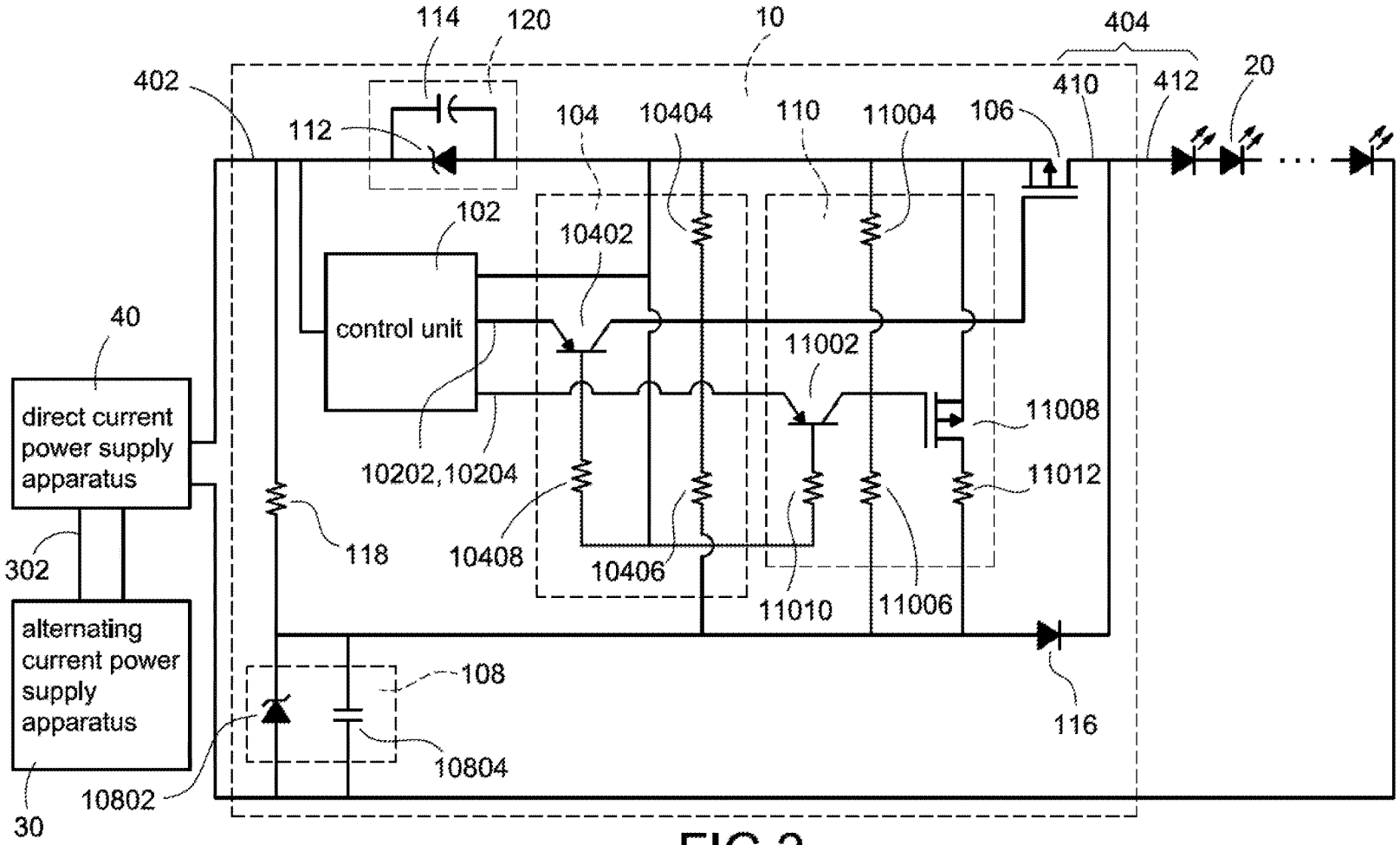
FIG. 2 shows a block circuit diagram of the second embodiment of the light emitting diode driving apparatus of the present invention.

FIG. 2 shows a block circuit diagram of the second embodiment of the light emitting diode driving apparatus of the present invention. The descriptions of the elements shown in FIG. 2 which are the same as the elements shown in FIG. 1 are not repeated here for brevity. The light emitting diode driving apparatus 10 further comprises a power-obtaining loop auxiliary circuit 110 and a signal-side resistor 118. The switch control circuit 104 comprises a transistor unit 10402, a first voltage-dividing resistor 10404, a second voltage-dividing resistor 10406 and a first resistor 10408. The power-obtaining loop auxiliary circuit 110 comprises an auxiliary transistor unit 11002, a first auxiliary voltage-dividing resistor 11004, a second auxiliary voltage-dividing resistor 11006, an auxiliary switch unit 11008, a first auxiliary resistor 11010 and a second auxiliary resistor 11012. The signal voltage generation unit 108 comprises a signal-side Zener diode 10802 and a signal-side capacitor 10804. The control power unit 120 comprises a control-side Zener diode 112 and a control-side capacitor 114. The transistor unit 10402 is, for example but not limited to, a bipolar junction transistor (BJT) or a metal oxide semiconductor field effect transistor (MOSFET). The auxiliary transistor unit 11002 is, for example but not limited to, a bipolar junction transistor or a metal oxide semiconductor field effect transistor.

The transistor unit 10402 is electrically connected to the control unit 102 and the signal switch unit 106. The first voltage-dividing resistor 10404 is electrically connected to the control unit 102, the signal switch unit 106 and the transistor unit 10402. The second voltage-dividing resistor 10406 is electrically connected to the signal switch unit 106, the transistor unit 10402, the first voltage-dividing resistor 10404 and the signal voltage generation unit 108. The first resistor 10408 is electrically connected to the control unit 102, the signal switch unit 106 and the transistor unit 10402. The power-obtaining loop auxiliary circuit 110 is electrically connected to the control unit 102, the switch control circuit 104, the signal switch unit 106 and the signal voltage generation unit 108. The auxiliary transistor unit 11002 is electrically connected to the control unit 102. The first auxiliary voltage-dividing resistor 11004 is electrically connected to the control unit 102, the switch control circuit 104, the signal switch unit 106 and the auxiliary transistor unit 11002. The second auxiliary voltage-dividing resistor 11006 is electrically connected to the switch control circuit 104, the signal voltage generation unit 108, the auxiliary transistor unit 11002 and the first auxiliary voltage-dividing resistor 11004. The auxiliary switch unit 11008 is electrically connected to the control unit 102, the switch control circuit 104, the signal switch unit 106, the auxiliary transistor unit 11002, the first auxiliary voltage-dividing resistor 11004 and the second auxiliary voltage-dividing resistor 11006. The first auxiliary resistor 11010 is electrically connected to the control unit 102, the switch control circuit 104, the signal switch unit 106 and the auxiliary transistor unit 11002. The second auxiliary resistor 11012 is electrically connected to the switch control circuit 104, the signal voltage generation unit 108, the auxiliary switch unit 11008 and the second auxiliary voltage-dividing resistor 11006. The control-side Zener diode 112 is electrically connected to the control unit 102, the switch control circuit 104 and the signal switch unit 106. The control-side capacitor 114 is electrically connected to the control unit 102, the switch control circuit 104, the signal switch unit 106 and the control-side Zener diode 112. The control-side capacitor 114 is connected to the control unit 102 and the control-side Zener diode 112 in parallel. The control-side capacitor 114 and the control-side Zener diode 112 are connected in parallel. The signal-side Zener diode 10802 is electrically connected to the switch control circuit 104 and the light emitting diode units 20. The diode 116 is electrically connected to the switch control circuit 104, the signal switch unit 106, the light emitting diode units 20 and the signal-side Zener diode 10802. The signal-side resistor 118 is electrically connected to the control unit 102, the switch control circuit 104, the signal-side Zener diode 10802 and the diode 116. The signal-side capacitor 10804 is electrically connected to the switch control circuit 104, the light emitting diode units 20, the diode 116, the signal-side resistor 118 and the signal-side Zener diode 10802.

The transistor unit 10402 is a pnp-type bipolar junction transistor. An emitter of the transistor unit 10402 is connected to the control unit 102. A base of the transistor unit 10402 is connected to the first resistor 10408. A collector of the transistor unit 10402 is connected to the signal switch unit 106. The signal switch unit 106 is a p-type metal oxide semiconductor field effect transistor. A source of the signal switch unit 106 is connected to the control-side Zener diode 112. A gate of the signal switch unit 106 is connected to the transistor unit 10402. A drain of the signal switch unit 106 is connected to the light emitting diode unit 20.

The auxiliary transistor unit 11002 is a pnp-type bipolar junction transistor. An emitter of the auxiliary transistor unit 11002 is connected to the control unit 102. A base of the auxiliary transistor unit 11002 is connected to the first auxiliary resistor 11010. A collector of the auxiliary transistor unit 11002 is connected to the auxiliary switch unit 11008. The auxiliary switch unit 11008 is a p-type metal oxide semiconductor field effect transistor. A source of the auxiliary switch unit 11008 is connected to the control-side Zener diode 112. A gate of the auxiliary switch unit 11008 is connected to the auxiliary transistor unit 11002. A drain of the auxiliary switch unit 11008 is connected to the second auxiliary resistor 11012.

The control unit 102 sends a low-level signal 10202 to the transistor unit 10402, so that the transistor unit 10402 is turned off. At this time, a voltage (for example, −5 volts or −10 volts) of the gate of the signal switch unit 106 is determined by the first voltage-dividing resistor 10404 and the second voltage-dividing resistor 10406. The voltage of the gate of the signal switch unit 106 is less than a voltage of the source of the signal switch unit 106, so that the signal switch unit 106 is turned on, so that the direct current power 402 is through the signal switch unit 106 to form the high-level part 410 of the lighting signal 404.

The control unit 102 sends a high-level signal 10204 to the transistor unit 10402, so that the transistor unit 10402 is turned on. At this time, the high-level signal 10204 is sent to the gate of the signal switch unit 106. The voltage of the gate of the signal switch unit 106 is a voltage of the high-level signal 10204 added by a voltage of a connection point of the first voltage-dividing resistor 10404 and the second voltage-dividing resistor 10406 (namely, the direct current power 402 is divided by the first voltage-dividing resistor 10404 and the second voltage-dividing resistor 10406), so that the voltage of the gate of the signal switch unit 106 is equal to or greater than the voltage (for example, the voltage of the source of the signal switch unit 106 added 5 volts) of the source of the signal switch unit 106, so that the signal switch unit 106 is turned off, so that a voltage of the drain of the signal switch unit 106 decreases. Then, the signal voltage generation unit 108 utilizes the direct current power 402 to form the low-level part 412 of the lighting signal 404. The low-level part 412 clamps the voltage of the drain of the signal switch unit 106 to avoid the voltage of the drain of the signal switch unit 106 being 0 volt. Moreover, if the voltage of the drain of the signal switch unit 106 is 0 volt, the light emitting diode units 20 cannot work. The low-level signal 10202 and the high-level signal 10204 will be described in detail later. Moreover, when the signal switch unit 106 is turned off, the signal voltage generation unit 108 utilizes the direct current power 402 to form the low-level part 412 of the lighting signal 404.

When the control unit 102 controls the switch control circuit 104 to turn off the signal switch unit 106, the control unit 102 obtains a power-obtaining path through the first voltage-dividing resistor 10404 and the second voltage-dividing resistor 10406, or the control unit 102 is supplied power by the control-side capacitor 114. However, in order to decrease current consumption, resistance values of the first voltage-dividing resistor 10404 and the second voltage-dividing resistor 10406 are usually larger. For circuit matching design, working current of the control unit 102 may be not enough. Therefore, in order to ensure that the control unit 102 can receive power normally, when the control unit 102 controls the switch control circuit 104 to turn off the signal switch unit 106, the power-obtaining loop auxiliary circuit 110 provides the control unit 102 with a power-obtaining loop to ensure the control unit 102 working. Moreover, resistance values of the first auxiliary voltage-dividing resistor 11004 and the second auxiliary voltage-dividing resistor 11006 are designed to be lesser.

When the control unit 102 sends the low-level signal 10202 to the transistor unit 10402, the transistor unit 10402 is turned off so the signal switch unit 106 is turned on, and the control unit 102 sends the high-level signal 10204 to the auxiliary transistor unit 11002 so the auxiliary transistor unit 11002 is turned on and the auxiliary switch unit 11008 is turned off. When the control unit 102 sends the high-level signal 10204 to the transistor unit 10402, the transistor unit 10402 is turned on so the signal switch unit 106 is turned off, and the control unit 102 sends the low-level signal 10202 to the auxiliary transistor unit 11002 so the auxiliary transistor unit 11002 is turned off and the auxiliary switch unit 11008 is turned on, so that the power-obtaining loop auxiliary circuit 110 provides the control unit 102 with the power-obtaining loop to ensure the control unit 102 working. Namely, when the signal switch unit 106 is turned off, the control unit 102 turns on the power-obtaining loop auxiliary circuit 110 to receive the direct current power 402 to ensure the working power required by the control unit 102. When the signal switch unit 106 is turned on, the control unit 102 turns off the power-obtaining loop auxiliary circuit 110. When the signal switch unit 106 is turned on, the control unit 102 sends the high-level signal 10204 to the auxiliary transistor unit 11002 so the auxiliary transistor unit 11002 is turned on and the auxiliary switch unit 11008 is turned off. When the signal switch unit 106 is turned off, the control unit 102 sends the low-level signal 10202 to the auxiliary transistor unit 11002 so the auxiliary transistor unit 11002 is turned off and the auxiliary switch unit 11008 is turned on. The auxiliary switch unit 11008 receives the direct current power 402 to ensure the working power required by the control unit 102.

The control-side Zener diode 112, the signal switch unit 106 and the light emitting diode units 20 are connected in series, so that a current path of the control unit 102 is the same with a current path of the light emitting diode units 20, so that a current flowing through the signal-side resistor 118 becomes smaller to improve the overheating problem of the related art. The control-side Zener diode 112 receives and clamps the direct current power 402 to supply power to the control unit 102. Originally a current of the current path of the light emitting diode units 20 is larger, and multiple light emitting diode units 20 can share power, so that the control unit 102 requiring larger current can be supplied sufficiently. Therefore, compared to the power-obtaining way of the control unit 102 that the control-side Zener diode 112 and the light emitting diode units 20 are connected in parallel, the present invention can greatly reduce temperatures of the control unit 102 and the signal-side resistor 118.

When the control unit 102 controls the switch control circuit 104 to turn off the signal switch unit 106, the signal-side Zener diode 10802 receives and clamps the direct current power 402 to form the low-level part 412 of the lighting signal 404.

The source of the signal switch unit 106 is connected to an anode of the control-side Zener diode 112, so that if the control unit 102 is connected to the signal switch unit 106 directly, because of the low-level signal 10202 and the high-level signal 10204 sent by the control unit 102, a voltage difference between the source of the signal switch unit 106 and the gate of the signal switch unit 106 results that the drain of the signal switch unit 106 cannot be cut off. Therefore, the present invention utilizes a transistor circuit (namely, the switch control circuit 104 comprising the transistor unit 10402, the first voltage-dividing resistor 10404, the second voltage-dividing resistor 10406 and the first resistor 10408) to perform voltage level conversion.

Figure 3A:
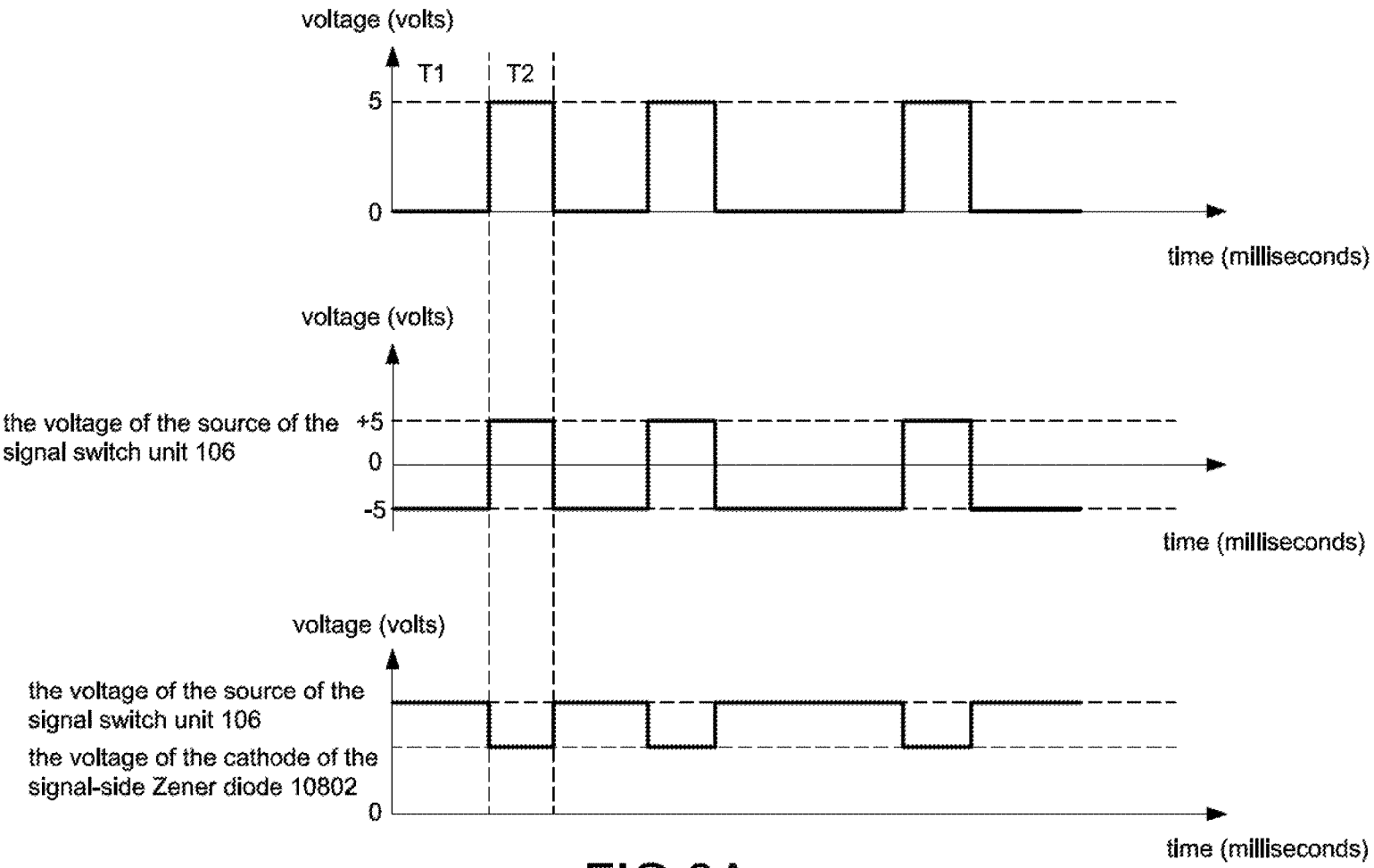
FIG. 3A and FIG. 3B show waveform diagrams of an embodiment of the present invention.
Figure 3B:
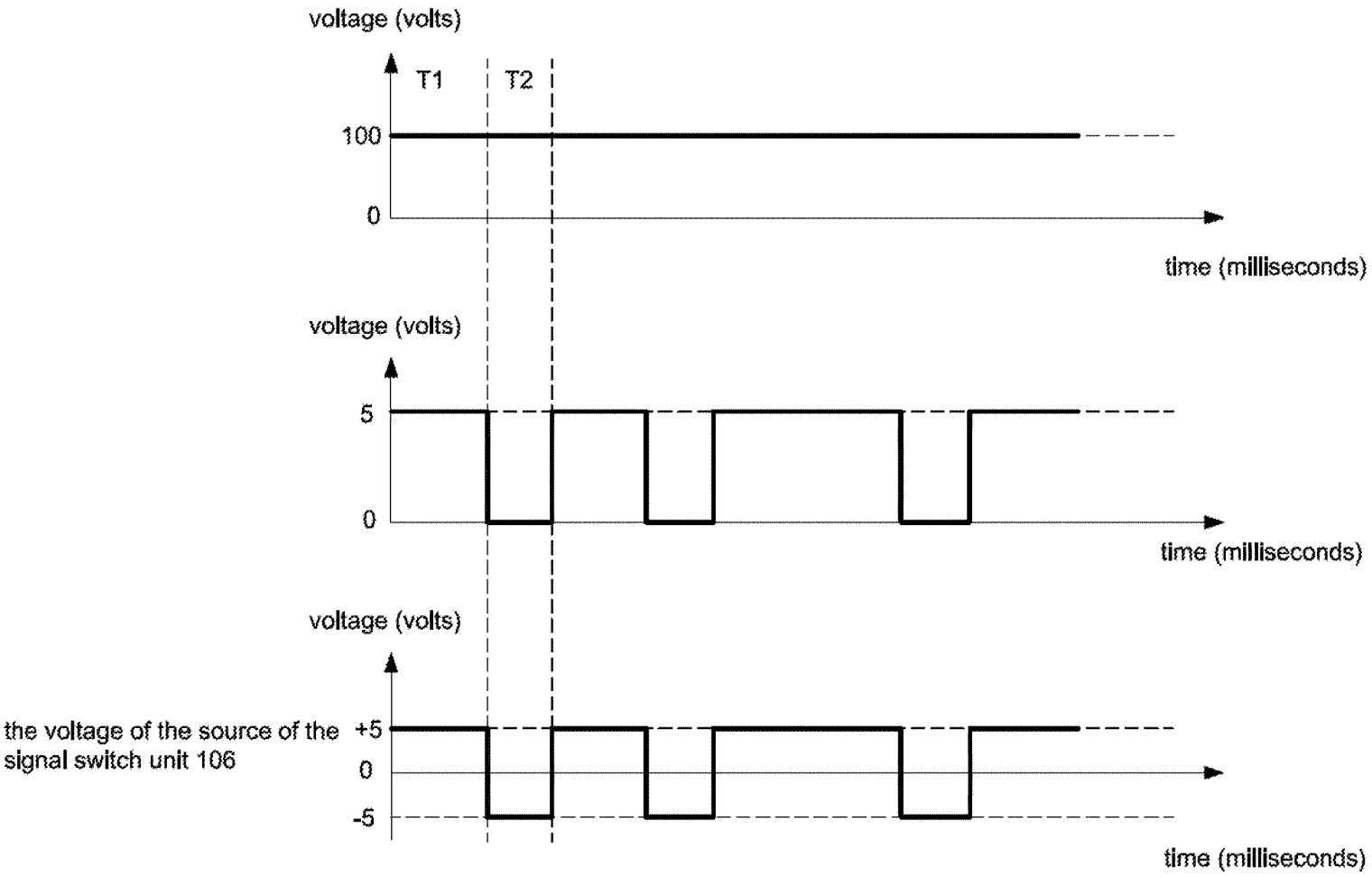

FIG. 3A and FIG. 3B show waveform diagrams of an embodiment of the present invention. Please refer to FIG. 2 at the same time. In FIG. 3A, a top-down first waveform is a voltage which is sent from the control unit 102 to the emitter of the transistor unit 10402. A top-down second waveform is the voltage of the gate of the signal switch unit 106. A top-down third waveform is the voltage of the drain of the signal switch unit 106 (namely, a voltage waveform of the lighting signal 404). In FIG. 3B, a top-down first waveform is the voltage of the source of the signal switch unit 106. A top-down second waveform is a voltage which is sent from the control unit 102 to the emitter of the auxiliary transistor unit 11002. A top-down third waveform is a voltage of the gate of the auxiliary switch unit 11008.

As shown in FIG. 3A and FIG. 3B:

In a first time interval T1: The control unit 102 sends the low-level signal 10202 which is 0 volt to the emitter of the transistor unit 10402. The voltage of the gate of the signal switch unit 106 is −5 volts. The high-level part 410 of the lighting signal 404 is the voltage of the source of the signal switch unit 106. The voltage of the source of the signal switch unit 106 is 100 volts. The voltage sent from the control unit 102 to the emitter of the auxiliary transistor unit 11002 is 5 volts. The voltage of the gate of the auxiliary switch unit 11008 is the voltage of the source of the signal switch unit 106 added 5 volts.

In a second time interval T2: The control unit 102 sends the high-level signal 10204 which is 5 volts to the emitter of the transistor unit 10402. The voltage of the gate of the signal switch unit 106 is the voltage of the source of the signal switch unit 106 added 5 volts. The low-level part 412 of the lighting signal 404 is a voltage of a cathode of the signal-side Zener diode 10802.

The voltage of the source of the signal switch unit 106 is 100 volts. The voltage sent from the control unit 102 to the emitter of the auxiliary transistor unit 11002 is 0 volt. The voltage of the gate of the auxiliary switch unit 11008 is −5 volts. Namely, the voltage sent from the control unit 102 to the emitter of the auxiliary transistor unit 11002 is opposite to the voltage sent from the control unit 102 to the emitter of the transistor unit 10402 (namely, reverse control), and the voltage of the gate of the auxiliary switch unit 11008 is opposite to the voltage of the gate of the signal switch unit 106.

Figure 4:
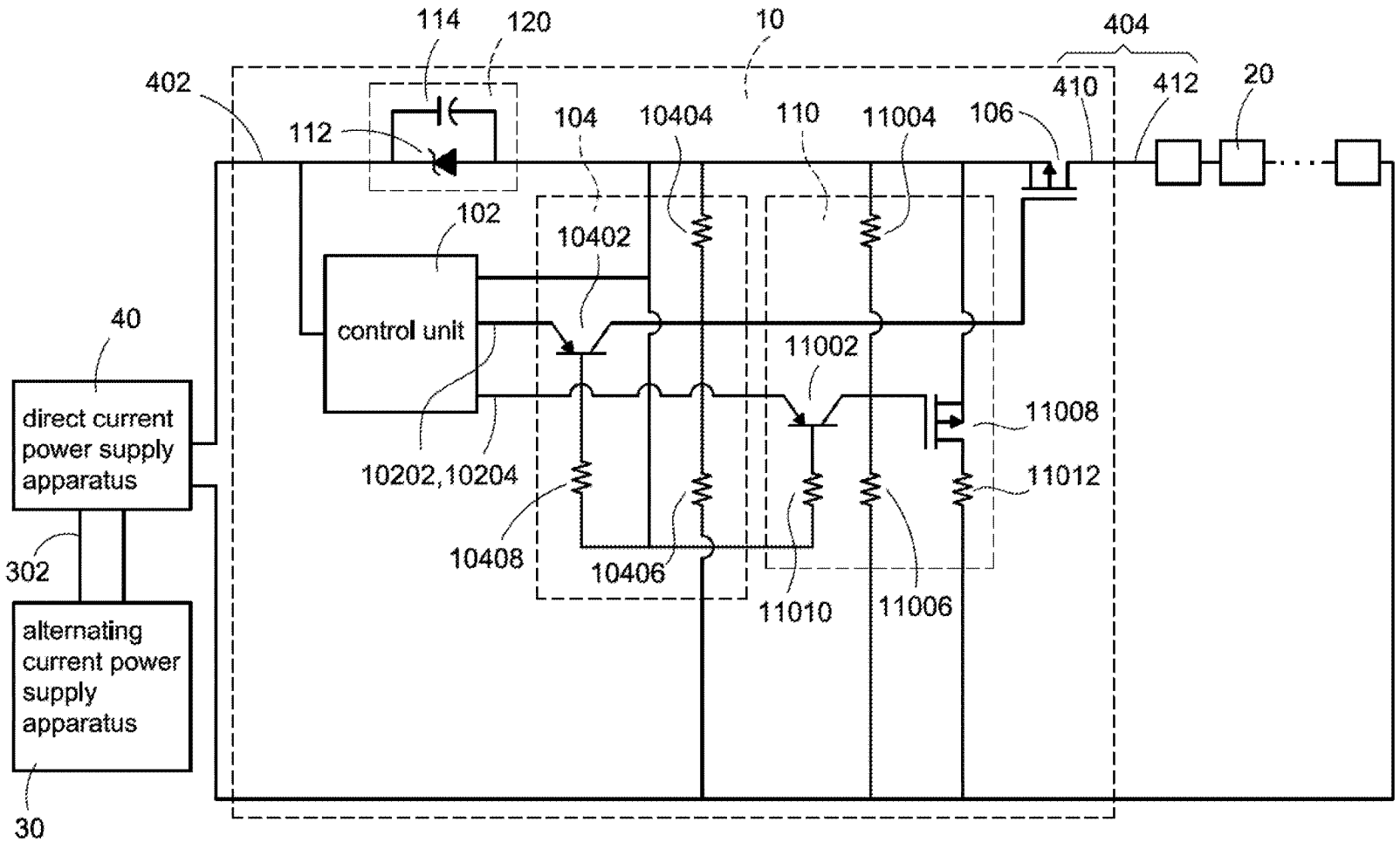
FIG. 4 shows a block circuit diagram of the third embodiment of the light emitting diode driving apparatus of the present invention.
Figure 8:
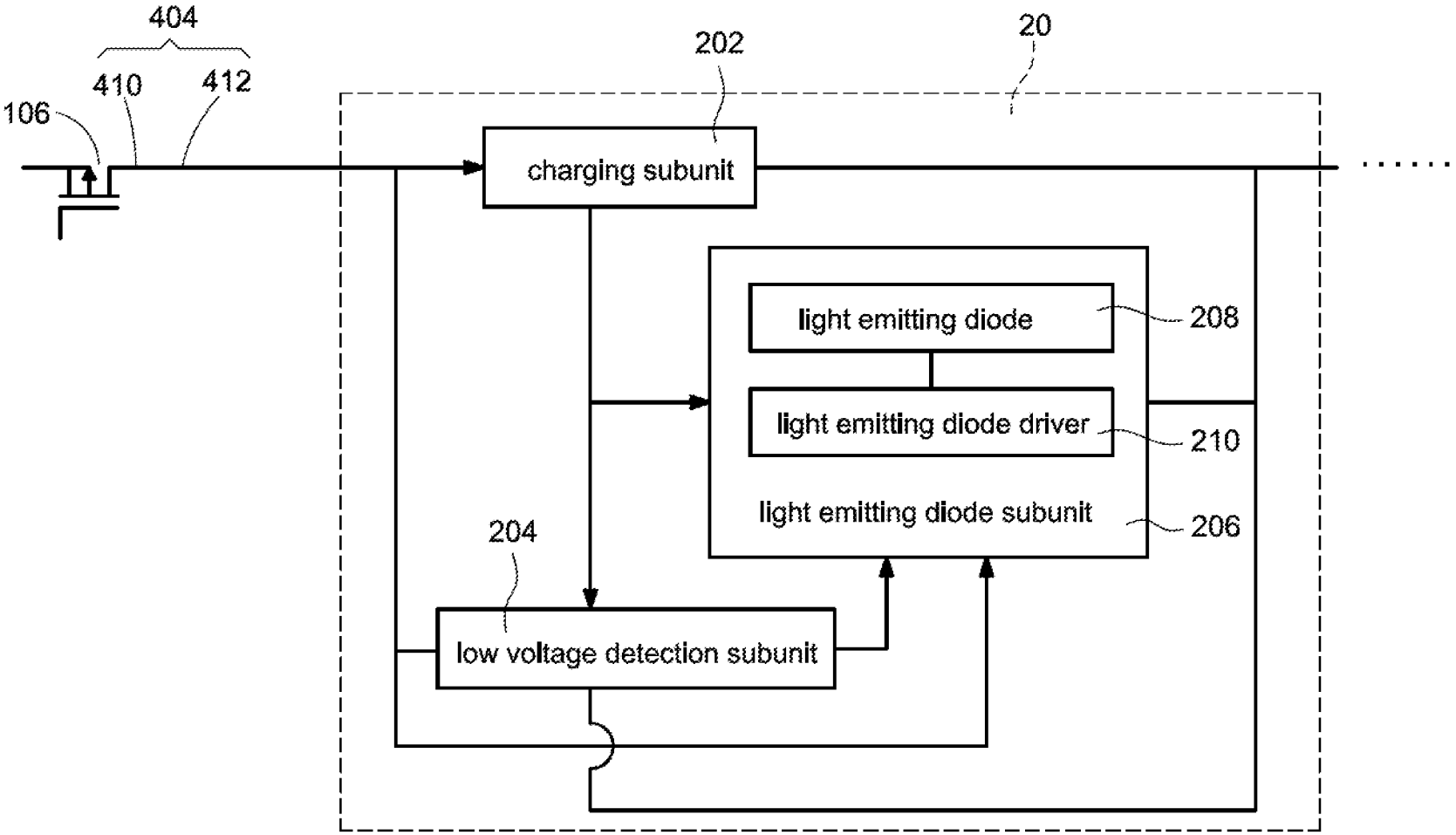
FIG. 8 shows a block diagram applied to the light emitting diode unit in FIG. 4 and FIG. 6.

FIG. 4 shows a block circuit diagram of the third embodiment of the light emitting diode driving apparatus of the present invention. The descriptions of the elements shown in FIG. 4 which are the same as the elements shown in the figures mentioned above are not repeated here for brevity. FIG. 8 shows a block diagram applied to the light emitting diode unit in FIG. 4 and FIG. 6. As shown in FIG. 8, each of the light emitting diode units 20 comprises a charging subunit 202, a low voltage detection subunit 204 and a light emitting diode subunit 206. The light emitting diode subunit 206 comprises a light emitting diode 208 and a light emitting diode driver 210. The charging subunit 202 is electrically connected to the signal switch unit 106. The low voltage detection subunit 204 is electrically connected to the signal switch unit 106 and the charging subunit 202. The light emitting diode subunit 206 is electrically connected to the signal switch unit 106, the charging subunit 202 and the low voltage detection subunit 204. The light emitting diode 208 is electrically connected to the signal switch unit 106 and the charging subunit 202. The light emitting diode driver 210 is electrically connected to the signal switch unit 106, the charging subunit 202, the low voltage detection subunit 204 and the light emitting diode 208.

The light emitting diode unit 20 receives the high-level part 410 and the low-level part 412 (for example, 0 volt or near 0 volt) of the lighting signal 404. Based on the high-level part 410 and the low-level part 412 of the lighting signal 404, the light emitting diode driver 210 drives the light emitting diode 208 to perform a light mode switching. When the high-level part 410 of the lighting signal 404 is formed, the light emitting diode driving apparatus 10 utilizes the high-level part 410 of the lighting signal 404 to supply power to the light emitting diode unit 20. When the low-level part 412 of the lighting signal 404 is formed, the low voltage detection subunit 204 detects the low-level part 412 of the lighting signal 404 to inform the light emitting diode driver 210 of the low-level part 412 of the lighting signal 404, and the charging subunit 202 supplies power to the low voltage detection subunit 204 and the light emitting diode subunit 206.

Figure 5:
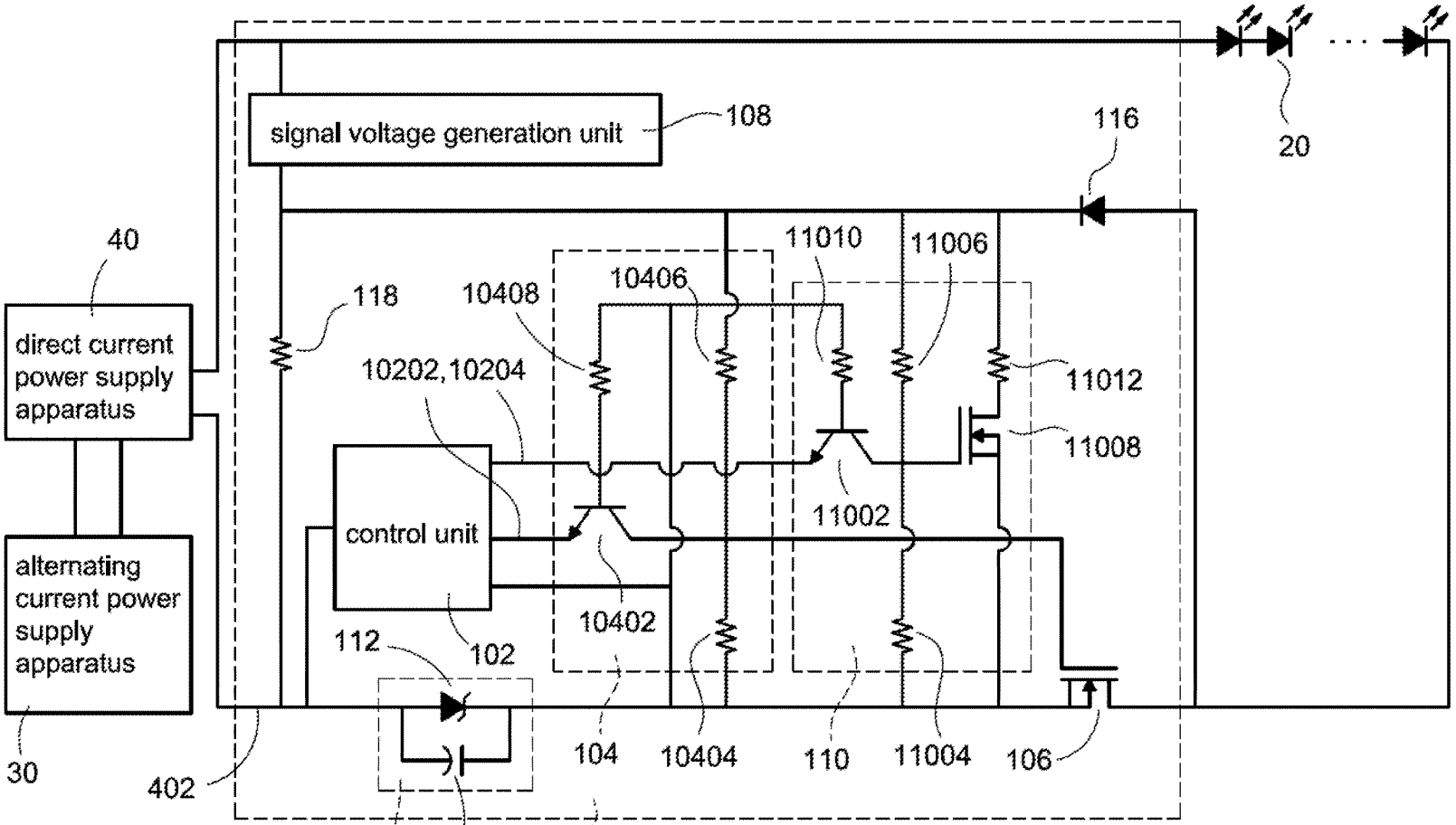
FIG. 5 shows a block circuit diagram of the fourth embodiment of the light emitting diode driving apparatus of the present invention.
Figure 6:
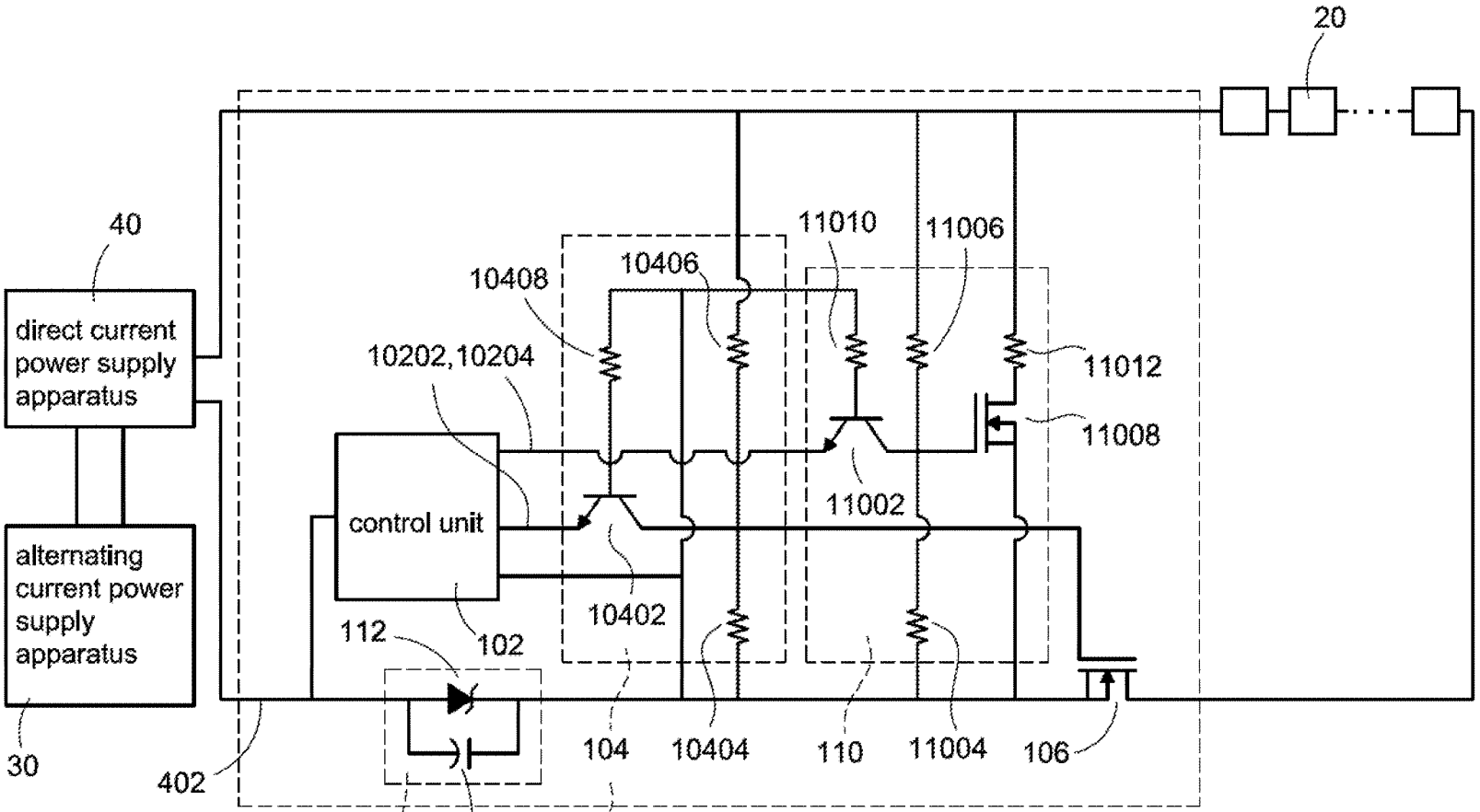
FIG. 6 shows a block circuit diagram of the fifth embodiment of the light emitting diode driving apparatus of the present invention.
Figure 7:
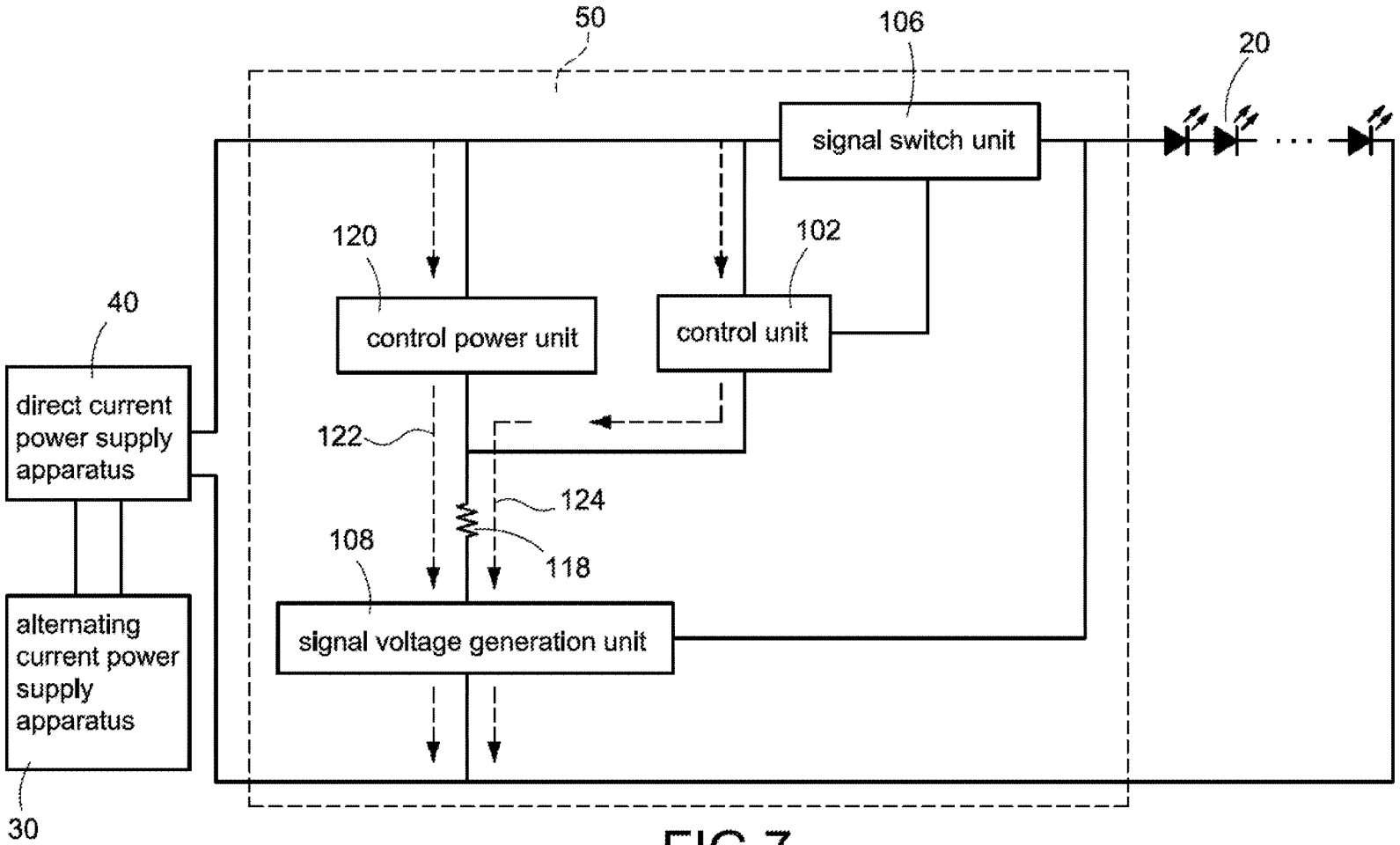
FIG. 7 shows a block circuit diagram of the related art light emitting diode driving apparatus.

FIG. 5 shows a block circuit diagram of the fourth embodiment of the light emitting diode driving apparatus of the present invention. The descriptions of the elements shown in FIG. 5 which are the same as the elements shown in FIG. 1~FIG. 4 are not repeated here for brevity. FIG. 6 shows a block circuit diagram of the fifth embodiment of the light emitting diode driving apparatus of the present invention. The descriptions of the elements shown in FIG. 6 which are the same as the elements shown in FIG. 1~FIG. 5 are not repeated here for brevity. As shown in FIG. 5 and FIG. 6, the elements mentioned above are arranged at a negative side reversely.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode driving apparatus applied to a plurality of light emitting diode units, the light emitting diode driving apparatus comprising:

a control unit;

a switch control circuit electrically connected to the control unit;

a signal switch unit electrically connected to the control unit, the switch control circuit and the light emitting diode units; and a control power unit configured to receive a direct current power to provide the control unit with a working power, the control power unit electrically connected to the control unit, the switch control circuit and the signal switch unit, wherein the control power unit, the signal switch unit and the light emitting diode units are connected in series;

wherein the control unit is configured to control the switch control circuit to switch a turned-on status and a turned-off status of the signal switch unit to generate a lighting signal to drive the light emitting diode units; when the signal switch unit is turned on, the direct current power is through the signal switch unit to form a high level part of the lighting signal; when the signal switch unit is turned off, the direct current power is not through the signal switch unit, so that a low level part of the lighting signal is formed;

wherein the control power unit comprises:

a control-side zener diode electrically connected to the control unit, the switch control circuit and the signal switch unit; and a control-side capacitor electrically connected to the control unit, the switch control circuit, the signal switch unit and the control-side zener diode, wherein the control-side capacitor is connected to the control unit and the control-side zener diode in parallel; and wherein the control-side zener diode, the signal switch unit and the light emitting diode units are connected in series; and the control-side zener diode is configured to receive and clamp the direct current power to supply power to the control unit.

2. The light emitting diode driving apparatus in claim 1 further comprising:

a signal voltage generation unit electrically connected to the control unit, the switch control circuit, the light emitting diode units and the signal switch unit, wherein when the signal switch unit is turned off, the signal voltage generation unit is configured to utilize the direct current power to form the low level part of the lighting signal.

3. The light emitting diode driving apparatus in claim 2, wherein the signal voltage generation unit comprises:

a signal-side zener diode electrically connected to the switch control circuit and the light emitting diode units, wherein when the control unit controls the switch control circuit to turn off the signal switch unit, the signal-side zener diode is configured to receive and clamp the direct current power to form the low level part of the lighting signal.

4. The light emitting diode driving apparatus in claim 3 further comprising:

a diode electrically connected to the switch control circuit, the signal switch unit, the light emitting diode units and the signal-side zener diode; and a signal-side resistor electrically connected to the control unit, the switch control circuit, the signal-side zener diode and the diode, wherein the signal voltage generation unit further comprises:

a signal-side capacitor electrically connected to the switch control circuit, the light emitting diode units, the diode, the signal-side resistor and the signal-side zener diode.

5. The light emitting diode driving apparatus in claim 1, wherein the switch control circuit comprises:

a transistor unit electrically connected to the control unit and the signal switch unit, wherein the control unit is configured to send a low level signal to the transistor unit, so that the transistor unit is turned off and the signal switch unit is turned on; the control unit is configured to send a high level signal to the transistor unit, so that the transistor unit is turned on and the signal switch unit is turned off.

6. The light emitting diode driving apparatus in claim 5, wherein the switch control circuit further comprises:

a first voltage-dividing resistor electrically connected to the control unit, the signal switch unit and the transistor unit;

a second voltage-dividing resistor electrically connected to the signal switch unit, the transistor unit and the first voltage-dividing resistor; and a first resistor electrically connected to the control unit, the signal switch unit and the transistor unit.

7. The light emitting diode driving apparatus in claim 5, wherein the transistor unit is a bipolar junction transistor or a metal oxide semiconductor field effect transistor.

8. The light emitting diode driving apparatus in claim 1 further comprising:

a power-obtaining loop auxiliary circuit electrically connected to the control unit, the switch control circuit and the signal switch unit, wherein when the signal switch unit is turned off, the control unit is configured to turn on the power-obtaining loop auxiliary circuit to receive the direct current power to ensure the working power required by the control unit; when the signal switch unit is turned on, the control unit is configured to turn off the power-obtaining loop auxiliary circuit.

9. The light emitting diode driving apparatus in claim 8, wherein the power-obtaining loop auxiliary circuit comprises:

an auxiliary transistor unit electrically connected to the control unit; and an auxiliary switch unit electrically connected to the control unit, the switch control circuit, the signal switch unit and the auxiliary transistor unit, wherein when the signal switch unit is turned on, the control unit is configured to send the high level signal to the auxiliary transistor unit so the auxiliary transistor unit is turned on and the auxiliary switch unit is turned off; when the signal switch unit is turned off, the control unit is configured to send the low level signal to the auxiliary transistor unit so the auxiliary transistor unit is turned off and the auxiliary switch unit is turned on, and the auxiliary switch unit is configured to receive the direct current power to ensure the working power required by the control unit.

10. The light emitting diode driving apparatus in claim 9, wherein the power-obtaining loop auxiliary circuit further comprises:

a first auxiliary voltage-dividing resistor electrically connected to the control unit, the switch control circuit, the signal switch unit and the auxiliary transistor unit;

a second auxiliary voltage-dividing resistor electrically connected to the switch control circuit, the auxiliary transistor unit and the first auxiliary voltage-dividing resistor;

a first auxiliary resistor electrically connected to the control unit, the switch control circuit, the signal switch unit and the auxiliary transistor unit; and a second auxiliary resistor electrically connected to the switch control circuit, the auxiliary switch unit and the second auxiliary voltage-dividing resistor.

11. The light emitting diode driving apparatus in claim 9, wherein the auxiliary transistor unit is a bipolar junction transistor or a metal oxide semiconductor field effect transistor.

12. The light emitting diode driving apparatus in claim 1, wherein each of the light emitting diode units comprises:

a charging subunit electrically connected to the signal switch unit;

a low voltage detection subunit electrically connected to the signal switch unit and the charging subunit; and a light emitting diode subunit electrically connected to the signal switch unit, the charging subunit and the low voltage detection subunit, wherein the light emitting diode subunit comprises:

a light emitting diode electrically connected to the signal switch unit and the charging subunit; and a light emitting diode driver electrically connected to the signal switch unit, the charging subunit, the low voltage detection subunit and the light emitting diode, wherein the light emitting diode unit is configured to receive the high level part and the low level part of the lighting signal; based on the high level part and the low level part of the lighting signal, the light emitting diode driver is configured to drive the light emitting diode to perform a light mode switching;

wherein when the high level part of the lighting signal is formed, the light emitting diode driving apparatus is configured to utilize the high level part of the lighting signal to supply power to the light emitting diode unit;

wherein when the low level part of the lighting signal is formed, the low voltage detection subunit is configured to detect the low level part of the lighting signal to inform the light emitting diode driver of the low level part of the lighting signal, and the charging subunit is configured to supply power to the low voltage detection subunit and the light emitting diode subunit.

* * * * *